United States Patent [19]

Lister

[11] 4,012,864

[45] Mar. 22, 1977

[54] TOY MOVIE STICK

[76] Inventor: D. Barry Lister, 667 Douglas St., Kamloops, British Columbia, Canada

[22] Filed: Jan. 19, 1976

[21] Appl. No.: 650,378

[52] U.S. Cl. ..... 46/47

[51] Int. Cl.[2] ..... A63H 33/22

[58] Field of Search ..... 46/47; 352/102

[56] References Cited

UNITED STATES PATENTS

| | | | |
|---|---|---|---|
| 1,516,718 | 11/1924 | Dailey | 352/102 |
| 2,319,046 | 5/1943 | Druce | 352/102 |
| 3,455,049 | 7/1969 | Dyer et al. | 46/47 |

*Primary Examiner*—Louis G. Mancene
*Assistant Examiner*—Robert F. Cutting
*Attorney, Agent, or Firm*—Joel Halpern

[57] ABSTRACT

The present invention relates to toy rubbing sticks of the character wherein the axial rubbing of the stick results in the imparting of rotational movement to an element mounted rotatably at one end of the stick.

4 Claims, 3 Drawing Figures

TOY MOVIE STICK

BACKGROUND OF THE INVENTION

Toy sticks which are notched axially and provided with a freely rotatable element at one end have been variously known as rubbing sticks, whirligigs, etc. and have been used widely for many years heretofore. By rubbing the notched stick either with the fingers or with another stick vibrations are created in the notched stick which, when the rubbing is sufficiently rapid, imparts a rotational movement to the rotatable element at the end of the stick. Reversal of the rubbing direction results in a reversal of the rotational direction. Such toys have been a continuing source of mysticism and enjoyment for children through the years. The principle of operation, although essentially unchanged, has been embodied in a variety of toys. U.S. Pat. No. 2,993,296 issued July 25, 1961 to A. Saastamo discloses a toy in which propellers are mounted upon a plurality of fingers and are caused to rotate in selected directions. U.S. Pat. No. 3,455,049 issued July 15, 1969 discloses an assemblage which may be used for display or amusement purposes including at least one shaft and at least one perforated element which may, when desired, be substituted for one or more of the shaft elements. By constructng an assemblage of such elements various visual arrangements may be created whereby the brushing or rubbing of notched portions of the shafts imparts rotation to the perforated elements.

SUMMARY OF THE INVENTION

It is the primary object of this invention to provide a toy movie stick by which a child, utilizing the principles of the rubbing stick may project animated figures upon a screen and reverse the sequence of movement when desired.

It is another object of this invention to provide a toy movie stick by which a child can easily carry and manipulate, utilizing the principles of the rubbing stick, a pair of elements and thereby produce a motion picture.

Other objects and advantages of the invention will become readily apparent from the following description of the invention.

According to the present invention there is provided a toy movie stick comprising in combination:

an elongated rod-like element having a row of substantially identically configured longitudinally-aligned notches formed along at least one surface thereof;

a first disc element rotatably mounted at one end of said rod-like element and provided with a plurality of circumferentially spaced apertures defining in sequence a series of related animated representations;

a second planar screen element mounted at said one end of said rod-like element coaxially with and longitudinally spaced outwardly from said first disc element;

means mounted on said rod-like element adapted to selectively project a beam of artificial illumination therealong and through the cut-out section in alignment therewith onto said second planar element;

and a rubbing member adapted to be stroked across and in contact with said row of notches of the rod-like element to thereby impart selected rotational movement to said first disc element.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
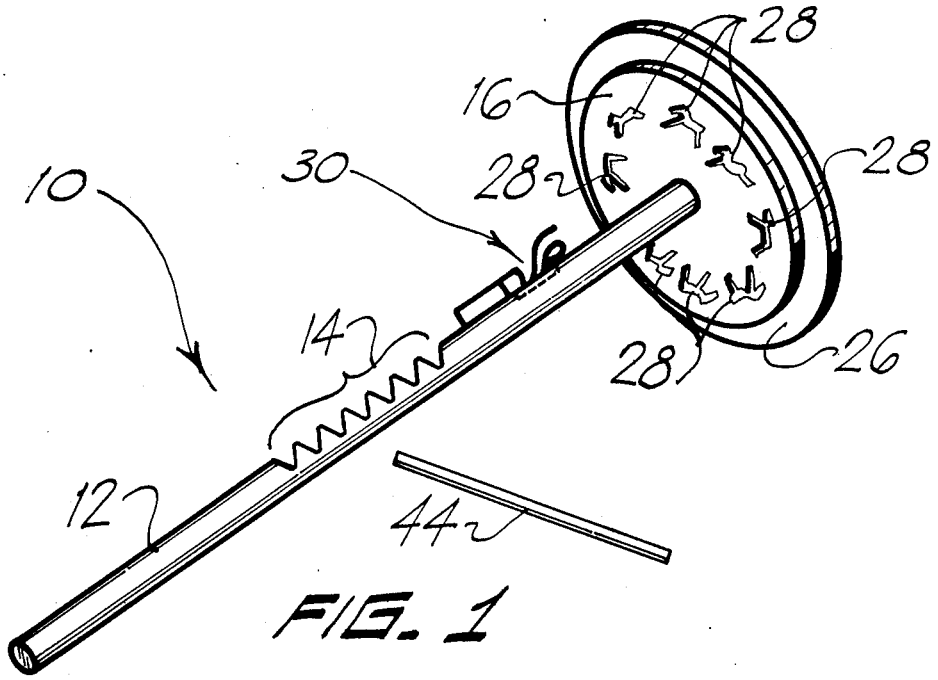
FIG. 1 is a perspective view of the toy movie stick embodying the invention.
Figure 2:
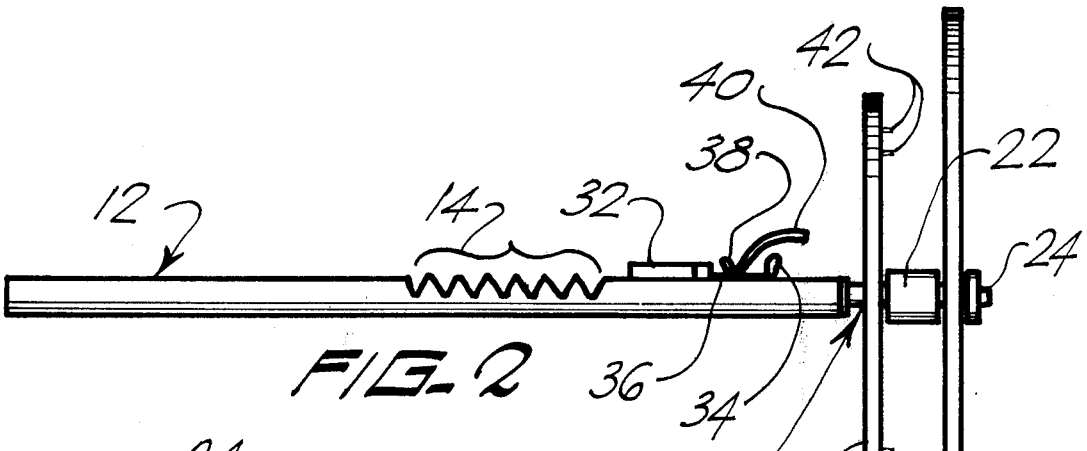
FIG. 2 is a side elevational view of the toy movie stick shown in FIG. 1.

Referring to the drawings there is shown generally a toy movie stick 10. The movie stick includes an elongated rod-like element or shaft 12 upon which a row of substantially identically configured longitudinally aligned notches 14 is formed. The notches are formed preferably along one surface of the shaft although it will be understood that one or more rows of such notches may be so provided.

Figure 3:
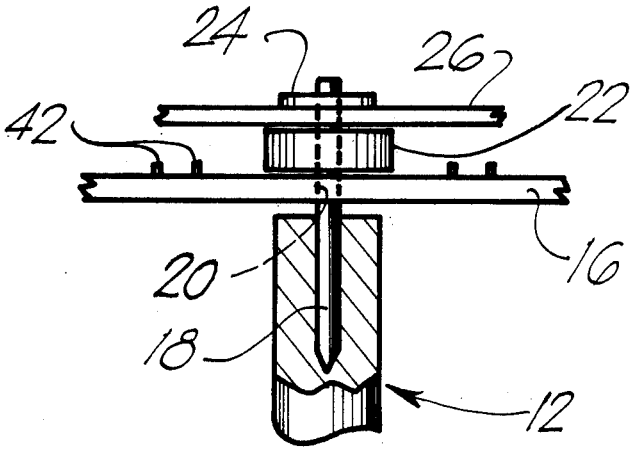
FIG. 3 is an enlarged side elevational view, partly in cross-section, showing the end of the stick provided with the rotational element and the mounting construction as well as the beam projecting construction.

At one end of the shaft there is secured a disc element 16 so as to be freely rotatable. Thus a pin element 18 is anchored fixedly in the end of the shaft and disc element 16 is given a central aperture 20 so that the disc element is loosely held at the end of the shaft. The pin element desirably is formed with a radial spacing projection 22 and with an end closure cap 24 as shown most clearly in FIG. 3. In this manner disc element 16 is held on the shaft 12 so as to be freely rotatable, and a second element 26, to be hereinafter described is maintained in fixed spaced relationship therewith.

As stated above, a second screen element 26, desirably planar and disc-shaped, is secured to pin element 18. Preferably the planar screen element is secured tightly between the spacing projection and closure cap of the pin element so as to be non-rotatable. By providing for the fixed mounting of screen element 26 there will be no diminution of the rotational force transmitted to disc element 16 due to the vibrational forces developed through rubbing of shaft 12. However, it will be understood that this is not critical to the invention, and indeed the screen element may be mounted upon the pin element in a rotatable fashion.

The screen element 26 is spaced from the disc element 16 to a distance which is sufficient to clearly focus thereon images defined by a series of cut-out sections 28 formed in the latter disc element as will be later described.

Mounted upon the shaft 12 for a purpose which will become clear are a combination of means 30 intended to selectively project a beam of artificial illumination along the shaft, through the cut-out section in disc element 16 which is in alignment with the beam and upon screen element 26. Such means include a battery 32, a bulb 34, electrical conductor element 36 which connects the battery and bulb, and switch 38 interposed in the electrical circuit connecting the battery and bulb. The bulb is desirably enclosed partially within a shield 40 so as to concentrate the beam of light at a localized point on disc element 16 directly forward of and in axial alignment with the bulb in order to project a clearer and sharper image upon screen 26.

As stated above, and as may be seen from FIG. 1, disc element 16 is provided with a series of circumferentially spaced cut-out sections 28 each defining one pictorial representation of a complete sequence of such representations. Thus, an entire sequence may consist of the sequential movement of a dog chasing and catching a cat, or a woodchopper felling a tree or any desired sequence of action steps. It is also within the contemplation of the invention to use the device as a teaching aid. When employed for this purpose the pictorial representations may take the form of a series of arithmetic problems and their solutions such as the teaching of addition, subtraction, division and multiplication. When presented to a child in this manner the lessons become enjoyable and the learning process becomes more efficacious.

Preferably, in order to produce a clearer, sharper image upon screen element 26 flange-like projections 42 are formed on the disc element 16 along the boundaries which define each cut-out section and extend from the surface of the disc element into the space between the disc element and the screen element.

A rubbing member 44 is provided consisting preferably of an elongated shaft which can be hand held and rubbed across the notches of shaft 12 to induce vibrations therein and to transmit rotary movement to disc element 16.

From the foregoing description of the device it will be seen that when it is desired to project a motion picture upon screen element 26 the child need simply to rapidly rub the member 44 across the notches of shaft 12 until the disc element is rotating thereon and then energize the bulb 34 by means of switch 38. A beam of light is thereby projected through cut-out sections 28 as they serially pass in front of the bulb, and a series of animated images are produced upon screen element 26. When desired, the child can reverse the sequence of images by reversing the rubbing direction of member 44 across notches 14. The movie stick can thus be utilized so as to be useful either as an enjoyable game or as an effective teaching aid.

I claim:

1. A hand-held toy movie stick comprising in combination:

an elongated rod-like element having a row of substantially identically configured longitudinally-aligned notches formed along at least one surface thereof;

a first disc element rotatably mounted at one end of said rod-like element and provided with a plurality of circumferentially spaced apertures defining in sequence a series of related amimated representations;

a second planar screen element having a light-reflective surface mounted at said one end of said rod-like element coaxially with and longitudinally spaced outwardly from said first disc element;

means mounted on said rod-like element adapted to selectively project a beam of artificial illumination therealong and through the apertured section of said first disc element in alignment therewith and onto said second planar element for reflection therefrom;

and a rubbing member adapted to be stroked across and in contact with said row of notches of the rod-like element to thereby impart selected rotational movement to said first disc element.

2. A toy movie stick according to claim 1, wherein said beam projecting means includes a battery, a switch and a shielded bulb mounted on said rod-like element in alignment with said row of notches, said bulb being positioned intermediate the end of said row of notches and said first disc element.

3. A toy movie stick according to claim 1, wherein said second planar screen element is non-rotatably secured to said rod-like element.

4. A toy movie stick according to claim 1, wherein flange-like projections are formed on said first disc element along the boundaries defining said cut-out sections, said projections extending from the plane of said disc element into the space between the disc element and said planar screen element.

* * * * *